US006657112B1

(12) United States Patent
Zigounakis

(10) Patent No.: US 6,657,112 B1
(45) Date of Patent: Dec. 2, 2003

(54) NOTE BENDING BY NECK PIVOTING

(76) Inventor: Gorgos M. Zigounakis, P.O. Box 586, Inverness, CA (US) 94937

( * ) Notice: Subject to any disclaimer, the term of this patent is extended or adjusted under 35 U.S.C. 154(b) by 9 days.

(21) Appl. No.: 10/153,191

(22) Filed: May 23, 2002

Related U.S. Application Data

(60) Provisional application No. 60/292,450, filed on May 21, 2001.

(51) Int. Cl.[7] ..... G10D 3/00

(52) U.S. Cl. ..... 84/293; 84/314 R; 84/291; 84/267

(58) Field of Search ..... 84/293, 291, 314 R, 84/267

(56) References Cited

U.S. PATENT DOCUMENTS

| | | | | | |
|---|---|---|---|---|---|
| 1,671,942 | A | * | 5/1928 | Strupe | 84/293 |
| 1,932,975 | A | * | 10/1933 | Kuhrmeyer | 84/293 |
| 4,433,603 | A | * | 2/1984 | Siminoff | 84/726 |
| 5,994,633 | A | * | 11/1999 | Norton | 84/290 |

* cited by examiner

*Primary Examiner*—Shih-Yung Hsieh

(57) ABSTRACT

An improved stringed musical instrument (10) with a neck (12) which can be pivoted by wrist motion relative to the body (11). This action changes the length and therefore pitch of the strings. In addition, the pivot motion (P) may also adjust various electronic controls (51) to vary a variety of other effects commonly used in modern music. The operation leaving the musicians feet, hands, and fingers free to play in all other normal manners.

1 Claim, 4 Drawing Sheets

NOTE BENDING BY NECK PIVOTING

CROSS-REFERENCES TO RELATED APPLICATION

This invention uses the concept of my provisional Patent Application, App.Nr. 60/292,450, Filed May 21, 2001.

BACKGROUND

1. Field of Invention

This invention relates to musical instruments, specifically those with strings.

2. Description of Prior Art

Musicians commonly look for new sounds and combinations of sounds to enhance their pieces, in addition to perfecting the execution of the pieces they preform. A common practice to this end is for a musician to move a finger which is holding a note or chord (by virtue of depressing strings above a fret) transversely across the fret or finger board. This slightly changes the length of the strings from fret to bridge. The result is a note which changes pitch (or bends) as the performer executes the operation—either holding or oscillating. Bending a sound in this manner is satisfactory, though rather subtle. However, it is difficult to bend some chords because three or four fingers depressing different strings must all move transversely in unison.

Several inventors have attempted to alleviate this difficulty by having the above mentioned string length change by a re-positioning of the neck. U.S. Pat. No. 1,747,650 to Sawyer (1930), U.S. Pat. No. 1,755,019 to Parker (1930), and U.S. Pat. No. 4,616,550 to Lacroix (1984) all propose a neck which is either flexible or hinged at the instrument body. The problem with these innovations is that they change the height (or action) of the strings above the finger board because they vary the angle of the neck and body from a common longitudinal plane. U.S. Pat. No. 3,447,412 to Marshall (1969) proposes a guitar which does this and is also capable of a "rotary displacement" of said parts. Assuming that the angular displacement of the Marshall invention could be controlled, the pivot mentioned would still have to be very slight in order to not compromise the action, resulting in a very subtle change of sound.

The action of a stringed musical instrument is so important that many patents have been issued just for the purpose of controlling it. U.S. Pat. No. 1,671,942 to Strupe (1928), U.S. Pat. No. 1,707,192 to Overton (1929), U.S. Pat. No. 1,785,266 to Lange (1930), U.S. Pat. No. 5,679,910 to Steinberger et al. (1997), U.S. Pat. No. 5965,830 to Carlson (1999), and U.S. Pat. No. 6,198,030 B1 to Rose (2001) all address this problem. These adjustments and such are all of a semi-permanent nature and are not used during play.

Another method of achieving bending is presently accomplished by moving the bridge on the body of the instrument away from the nut. This operation is generally referred to as Tremolo or Vibrato, and is so well established that numerous patents have been issued just to fine tune the mechanics of the process. Refer to U.S. Pat. No. 607,359 to Forrest (1898), U.S. Pat. No. 1,716,747 to Warner (1929), U.S. Pat. No. 2,972,923 to Fender (1961), U.S. Pat. No. 3,124,991 to Costen (1964), U.S. Pat. No. 4,457,201 to Storey (1982), U.S. Pat. No. 4,674,389 to Fender (1987), U.S. Pat. No. 4,704,936 to Steinberger (1987), U.S. Pat. No. 4,742,750 to Storey (1988), U.S. Pat. No. 5,046,393 to Xenidis (1991), U.S. Pat. No. 5,637,818 to Fishman (1997), and U.S. Pat. No. 6,084,166 to Lee (2000); representing only a few of these inventions.

The disadvantage of all current tremolo devices is that they require operation (by means of a lever or push buttons or paddles) from the same arm which is involved in playing the strings—compromising the complexities which this hand can achieve. The only exception to this may be the truly innovative U.S. Pat. No. 134,679 issued to Knaffl in 1873 which achieved "tension of the strings, and thus to sharpen the sounds independently . . . by means of a (foot) treadle,". The disadvantage of this invention falls into the category addressed below.

With the advance of electric musical instruments, the field of sound enhancement has expanded to also include tone, volume, wah, wammy, delay speed, echo, decay, intonation, overdrive, distortion, dimensional processing, etc. I will refer to all these enhancements and those that have yet to be developed as "effect". Some of these are built into the modern-electric instruments in the form of knobs and levers. These need to be operated by one of the hands which could be used on the strings —like the tremolo referred to above. Other effects are accessed through a host of foot peddles (not unlike the Knaffle) and similar controls which the musician operates while using both hands to play the instrument. Many effects are made by the musician actually turning away and operating controls or even rubbing the instrument on the amplifier, while playing.

Though done, an effect which requires the musician to use one hand to accomplish is less than ideal because one losses the ability of that hand to continue playing the strings. By the same token, an effect which limits the musician to an area directly behind foot controls (or worse yet, facing an amplifier) does not allow one the freedom to move to other musicians or into the audience, which is one reason that today's new music is so dynamic.

Many pivotal adjustments of the neck of a stringed instrument which do not change the angle to the body and therefore the action have been proposed. U.S. Pat. No. 5,390,578 to Raymer (1995) concerns rotating the neck of a guitar into the body for storage purposes. U.S. Pat. No. 5,994,633 to Norton (1999) also pivots the neck relative to the body to facilitate storage but it also may be locked into a position askew to the plane of the body to the taste and comfort of the player. U.S. Pat. No. 4,534,260 to Burrell (1985), U.S. Pat. No. 5,852,249 to Steinberg et al. (1998), and U.S. Pat. No. 6,034,308 to Little (2000), also address the issue of skew; but all these inventions refer to the alignment being fixed permanently or a least not during the course-of play. U.S. Pat. No. 4,981,063 to Roberts (1991) appears to be a multitude of guitar necks which can pivot into position as the instrument is played.

However, the Roberts invention is actually 4 individual instruments, each complete with its own bridge and pick up (usually found on the body of the instrument). The pivoting brings a different instrument into play rather than changing the sound of the instrument in play

OBJECTS AND ADVANTAGES

Accordingly, several objects and advantages of the present invention are:

(a) to provide a method of easily bending the notes and chords of a stringed musical instrument by slightly pivoting the neck in relationship to the body while keeping those parts in their same relative longitudinal plane;

(b) to provide a method of varying any electrically produced effect on a stringed musical instrument by slightly pivoting the neck in relationship to the body while keeping those parts in their same relative longitudinal plane;

(c) to provide a method of producing the above mentioned effects while allowing one hand to freely select and change notes and chords on the fingerboard of a stringed musical instrument;

(d) to provide a method of producing the above mentioned effects while allowing one hand to freely strum, pick, pluck, or in any way vibrate the strings of the musical instrument;

(e) to provide a method of producing the above mentioned effects with a stringed musical instrument and be free to move about to any location on the floor or stage.

Further objects and advantages are to provide a stringed musical instrument which is simple to use and inexpensive to manufacture, and which can be produced in mass or individually. Still further objects and advantages will become apparent from consideration of the ensuing description and drawings.

DRAWING FIGURES

In the drawings, closely related figures have the same number but different alphabetic suffixes.

DETAIL DESCRIPTION—FIGS. 1 TO 6

Figure 1:
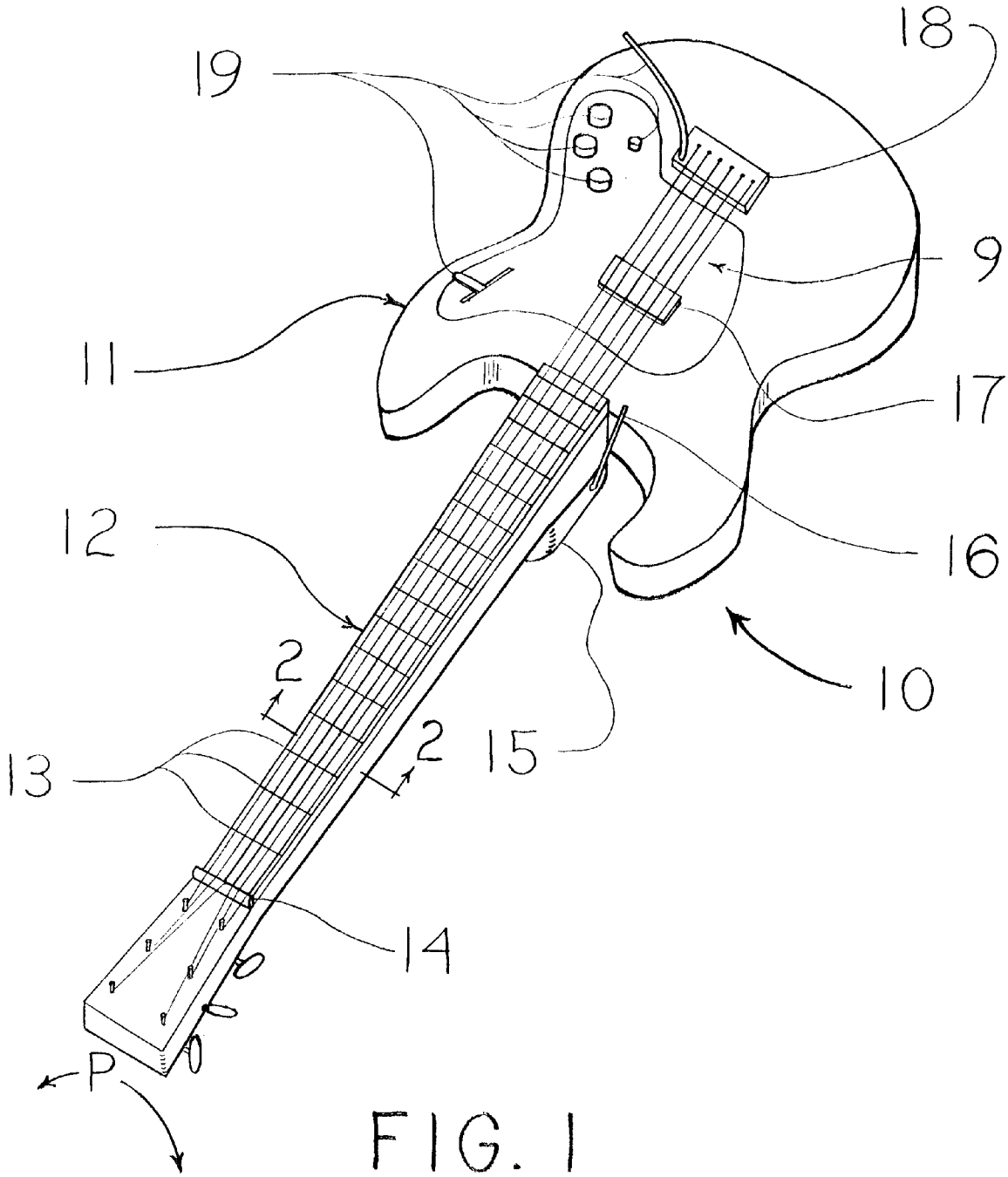
FIG. 1 shows a typical stringed musical instrument of the electric variety.

A typical embodiment of the present invention is illustrated in FIG. 1. An electric guitar 10 is made of two parts; a body 11, and a neck 12. A plurality of strings 9 stretch from a nut 14, across a set of frets 13 (only three are connected to the reference numeral with lead lines for-simplicity, but in this FIG. there are seventeen), and terminate at a bridge 18. A pickup 17 aids in the electrical enhancement of the string vibration. A plurality (six in this FIG.) of controls 19 are available to produce a variety of effects. The direction of pivot of the neck in relation to the body is shown with P. The mechanism which enables the pivot is protected under a cover 15. A pivot locking arm 16 is provided to keep the neck in a normal or neutral position when bending is not desired.

Figure 2A:
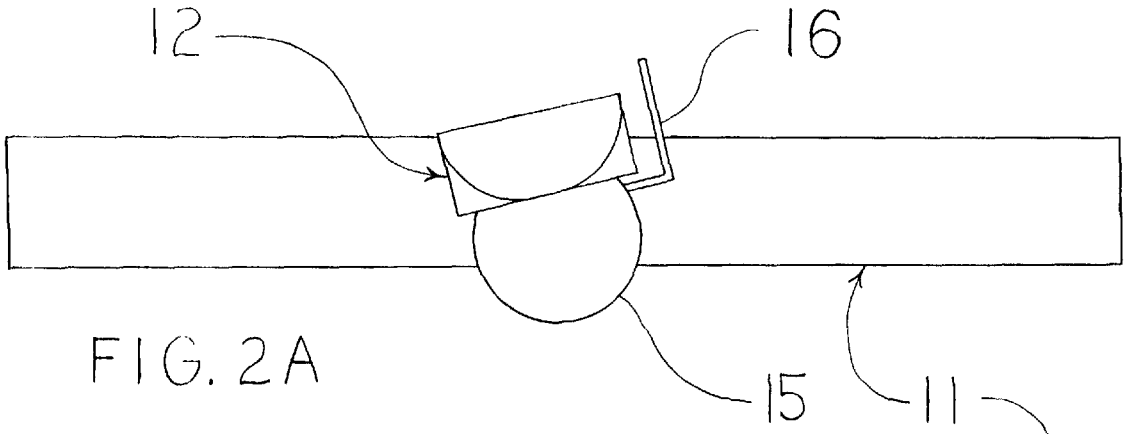
FIGS. 2A, 2B, 2C shows three different positions which the neck of the instrument may be pivoted transversly in relation to the body.
Figure 2B:
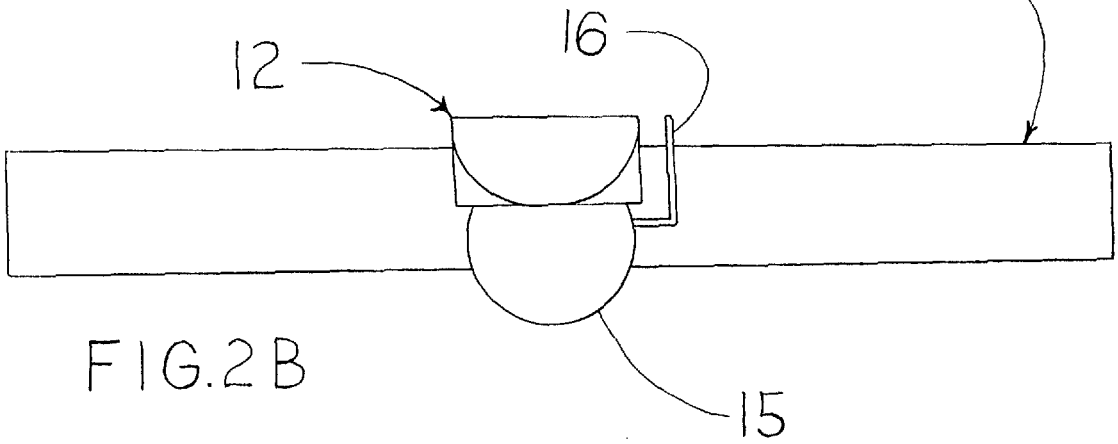
Figure 2C:
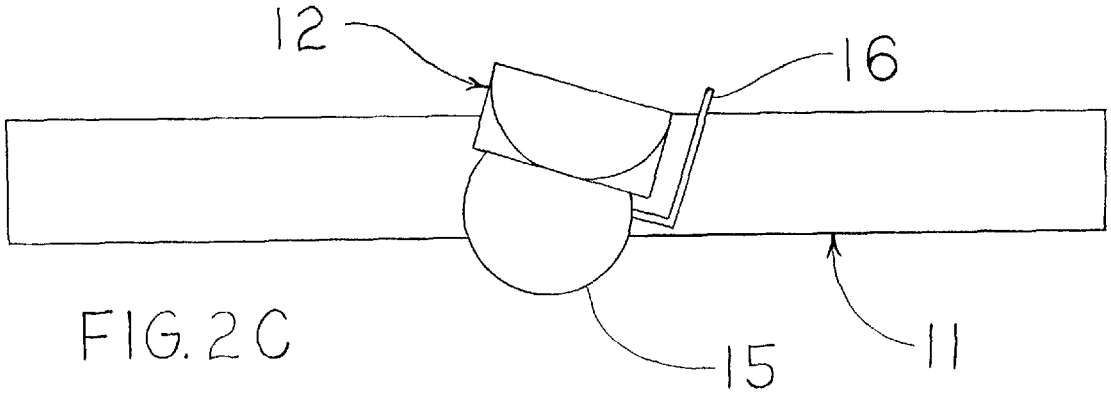

FIGS. 2A, 2B, 2C show the same instrument through section 2—2. In FIG. 2 A the neck 12 is pivoted to a counter-clockwise position, and the pivot locking arm 16 is disengaged. In FIG. 2B the neck is in the neutral position, and the locking arm 16 is engaged. In FIG. 2C the neck is pivoted to a clockwise position and the arm 16 is disengaged.

Figure 3:
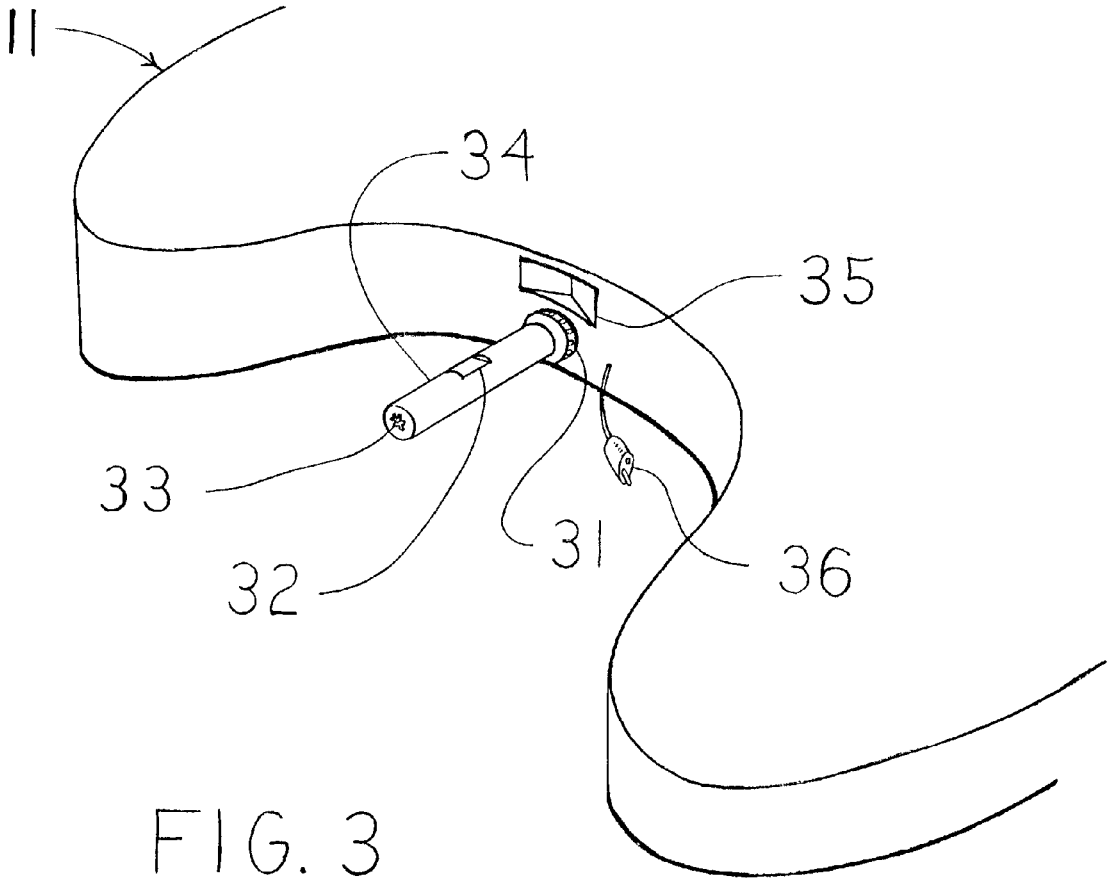
FIG. 3 shows a close up of the pivoting mechanism on the body of the same instrument with the neck removed.

In FIG. 3 the neck has been removed from the body 11 of the guitar. A strong pin or stud 34 is firmly bonded to and projecting from the body. A flat 32 is machined onto the stud in order to engage the locking arm 16 in a position which will hold the neck in the neutral position in relation to the body. The end of the stud has a hole 33, which is machined so as to be able to accept a pin 52 of a controller 51. A precisely formed and lined cavity 35 is built into the body to accept the ball of a "bullet catch" 45 so that an alignment of the neck to the neutral position is easily found. A "thrust bearing" 31 allows the neck to pivot easily. A flexible electrical connector 36 is provided so that the controller 51 can be engaged when the neck is in place. The electrical connector will lead through and into the guitar if a contrivance for the effects is within the instrument body, or through the body to an attached jack or transmitter if said contrivance for the effect is external.

Figure 4:
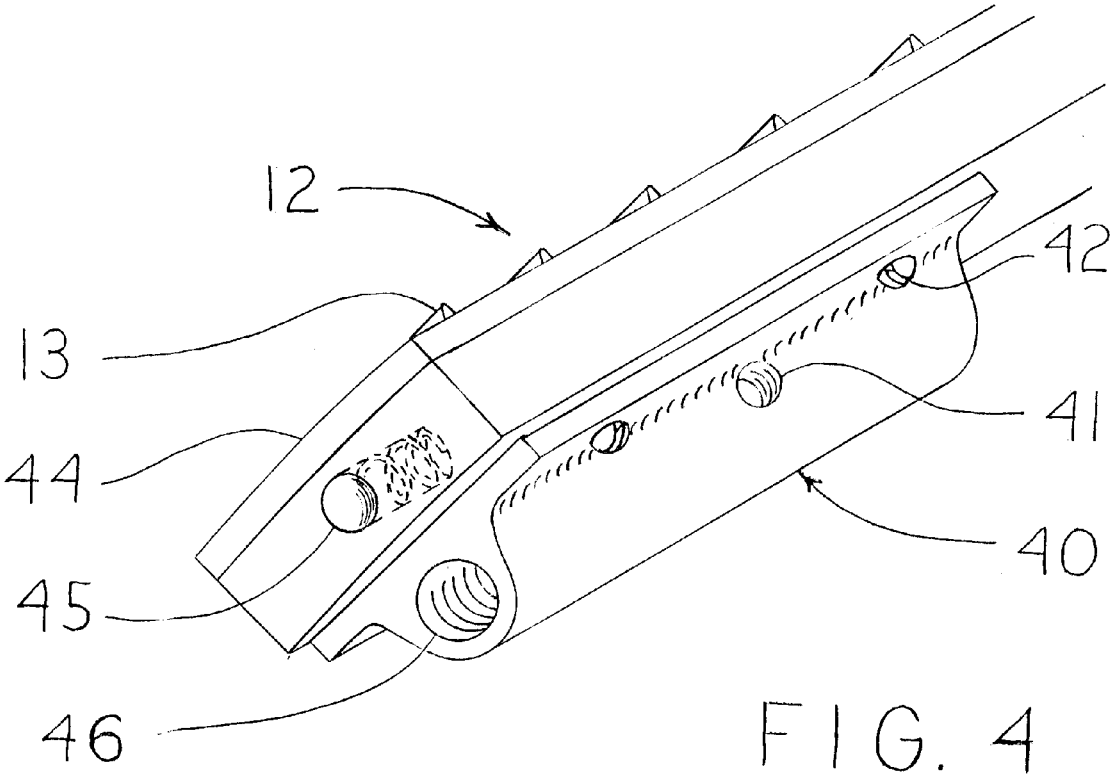
FIG. 4 shows a close up of the pivoting mechanism on the removed underside of the neck of the same instrument; as seen from the body side, with the cover removed.

In FIG. 4 we see the underside of the neck 12 with the cover 15 removed. The frets 13 (only one is shown with a lead to its numeral) are shown on a finger board 44. A "pillow-block bearing" 40 is shown securely fastened to the neck with fasteners 42. A hole 46 in the bearing accepts the stud 34 when the neck is in place. A tapped hole 41 in the bearing 40 accepts the pivot locking lever 16. The "bullet catch" 45 is built into the neck and engages cavity 35 when the neck is in place.

Figure 5:
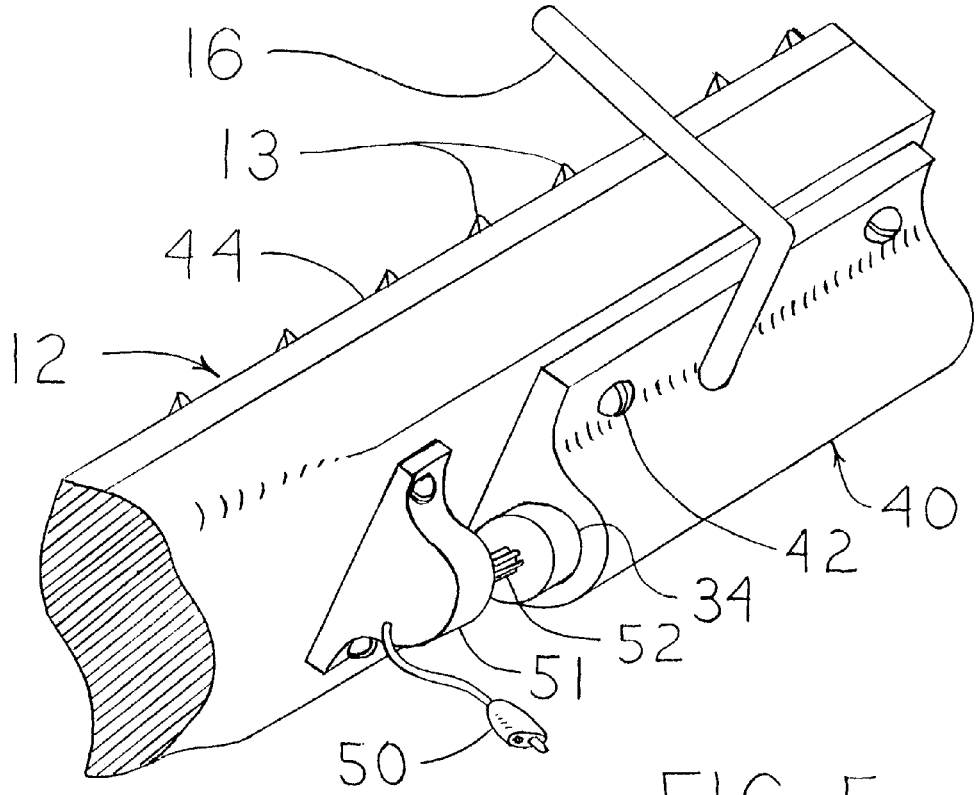
FIG. 5 shows a close up of the pivoting mechanism on the underside of the neck of the same instrument; as seen from the nut side of the neck, with the cover removed.

FIG. 5 is a close-up of the underside of the forward section of the neck 12 when it is engaged to the body. The cover 15 is removed. The pivot locking arm 16 is in a position that allows a pivot. The controller 51 is shown attached to the neck. This device is not unlike a potentiometer referred to in FIG. 1 as one of the controls 19 built into the body of an instrument, but could be any device or microprocessor which results in varying effect. The controller has a mating flexible electrical connector 50 which can be attached to the electrical connector 36, which is part of the body of the instrument. The controller has the pin 52 which is inserted into the hole 33 of the stud 34 so that a pivot of the neck causes the electrical change in value which ultimately causes the desired change in sound or effect.

Figure 6:
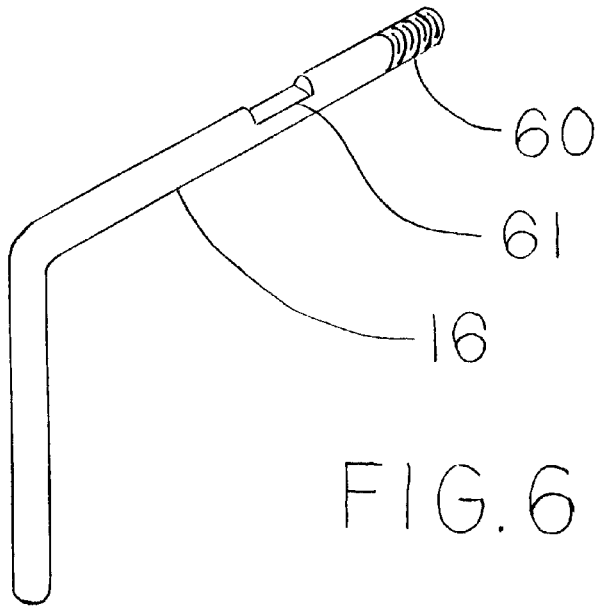
FIG. 6 shows a detail of the pivot locking arm.

The detail of the pivot locking arm 16 in FIG. 6 shows the underside. A threaded end 60 passes through the bearing 40, as shown in FIG. 5, and engages the threaded hole of the bearing 41, as shown in FIG. 4. A flat 61 allows the stud 34 to pass through and pivot in relation to the bearing 41 when in an upward position; but "cams" down on the flat 32 of the stud in any other position. Any clip or method to hold the arm in the upward position can be used, but is not illustrated here for reasons of simplicity.

OPERATION—FIGS. 1, 2, 5

The manner of using the neck pivoting musical instrument to achieve effect is similar to using a conventional stringed musical instrument. A performer will set the instrument in the neutral or normal position as shown in FIG. 2B. The musician may or may not engage the pivot locking arm 16 (FIG. 1). If the instrument is equipped with a variety of or programmable effects the artist will select and engage the desired process where appropriate so that the pivoting controller 51 (FIG. 5) will regulate the effect. The performer will then proceed to play the instrument in the manner in which those skilled in the art normally do.

When the musician comes to a part where bending a note or chord or any of the possible effects is desired, they will (after releasing the locking arm, if it has been engaged) pivot the neck 12 (FIG. 1) in the manner illustrated by P in FIG. 1, using a wrist action. The artist may pivot the neck to the position shown in FIG. 2A, or to the position shown in FIG. 2C, or may oscillate between them or any combination of these actions at any speed or pattern to suite their purpose.

This will result directly in sound changes whether of an acoustic or electronic (and not necessarily subtle) nature.

During this pivoting operation the performer will have both hands and both feet free to further enhance the music with the effects they would normally use. At conclusion of this novel play, the musician can return to conventional play by simply returning the instrument to the position shown in FIG. 2B and either lock or not lock the neck in place.

SUMMARY, RAMIFICATIONS, AND SCOPE

Accordingly, the reader will see that the sound bending by neck pivoting of an instrument can be used to achieve results which are highly coveted in the field of music, and not necessarily subtle at all. Furthermore, the pivoting innovation has the additional advantage that it permits a musician to make these effects with a rarely before used motion which can augment all previous methods for achieving these effects, resulting in combinations and innovations of sounds never before possible.

Although the description above contains many specificities, these should not be construed as limiting the scope of the invention but as merely providing illustrations of some of the presently preferred embodiments of this invention. For example, the controller operated by the pivoting motion could run effects other than sound, such as visuals.

Thus the scope of the invention should be determined by the appended claims and their legal equivalents, rather than by the examples given.

I claim:

1. A stringed musical instrument comprising a body part and a neck part and a means of attachment which allows a controlled pivoting of said parts in relation to each other whereby said pivoting causes changes in an electric controlling device which is disposed at the place of attachment of said parts, and which transfers said changes to an electric contrivance which causes changes to the sounds being made.

* * * * *